US011034468B2

(12) United States Patent
Lin

(10) Patent No.: US 11,034,468 B2
(45) Date of Patent: Jun. 15, 2021

(54) FILLING MACHINE

(71) Applicant: Chin-Tui Lin, Yuanlin (TW)

(72) Inventor: Chin-Tui Lin, Yuanlin (TW)

( * ) Notice: Subject to any disclaimer, the term of this patent is extended or adjusted under 35 U.S.C. 154(b) by 0 days.

(21) Appl. No.: 16/547,679

(22) Filed: Aug. 22, 2019

(65) Prior Publication Data

US 2021/0053703 A1 Feb. 25, 2021

(51) Int. Cl.
*B65B 3/12* (2006.01)
*B65B 3/08* (2006.01)

(52) U.S. Cl.
CPC . *B65B 3/12* (2013.01); *B65B 3/08* (2013.01)

(58) Field of Classification Search
CPC .. B65B 3/12; B65B 3/08; B65B 3/003; B65B 3/30; A61J 1/2096
USPC ..... 141/27
See application file for complete search history.

(56) References Cited

U.S. PATENT DOCUMENTS 1,269,348 A * 6/1918 Warren ..... A61M 5/1782 141/27
3,935,883 A * 2/1976 Stach ..... A61M 5/1782 141/27
4,187,890 A * 2/1980 Stach ..... A61M 5/1782 141/27
5,584,814 A * 12/1996 Schuster ..... B65B 3/003 222/326
7,556,623 B2 * 7/2009 Lyman ..... A61M 5/3213 206/365
2002/0101785 A1 * 8/2002 Edwards ..... B01F 11/0082 366/268
2011/0094619 A1 * 4/2011 Steel ..... B65B 55/02 141/27
2011/0208127 A1 * 8/2011 Haueter ..... A61M 5/16859 604/246
2014/0124087 A1 * 5/2014 Anderson ..... A61M 5/19 141/2

(Continued)

FOREIGN PATENT DOCUMENTS

TW M364082 U 9/2009
WO WO-2018036683 A1 * 3/2018 ..... G01F 11/021

OTHER PUBLICATIONS

SMC Corporation—Product Catalog, published 2013. Retreived from https://content2.smcetech.com/pdf/VT307.pdf.*

(Continued)

*Primary Examiner* — Timothy P. Kelly
*Assistant Examiner* — Christopher M Afful
(74) *Attorney, Agent, or Firm* — Alan D. Kamrath; Karin L. Williams; Mayer & Williams PC

(57) ABSTRACT

A filling machine includes a main body, a feeding unit, a movement unit, a power unit, a pipe unit, and two control units. The main body is provided with a first seat and a first mounting portion. The feeding unit is mounted on the main body and includes a second seat, a filling cylinder, a first plate, and a connecting member. The movement unit is movable relative to the feeding unit and includes a third seat, a first moving member, and a second plate. The power unit is arranged on the movement unit and includes a driving mechanism, and a second moving member. The pipe unit is assembled with the feeding unit, and includes a first line and a second line. The two control units are mounted on the main body to open or close the first line and the second line.

11 Claims, 14 Drawing Sheets

(56) References Cited

U.S. PATENT DOCUMENTS

| | | | | |
|---|---|---|---|---|
| 2015/0251781 | A1* | 9/2015 | Matsukuma | B25J 9/0087 141/2 |
| 2019/0151569 | A1* | 5/2019 | Fangrow | A61M 5/14546 |

OTHER PUBLICATIONS

SMC Corporation—Product Catalog, published 2018. Retrieved from https://www.smcpneumatics.com/VT307-5DZ1-02-F.html (Year: 2013).*
WO 2018/036683A1, English Translation (Year: 2018).*

* cited by examiner

FILLING MACHINE

BACKGROUND OF THE INVENTION

1. Field of the Invention

The present invention relates to a filling machine.

2. Description of the Related Art

A conventional filling machine was disclosed in the Taiwanese Patent Publication No. M364082, and comprises an electric control unit 10, a workbench 20, a cylinder unit 30, and a supply unit 40. The electric control unit 10 includes a proximity switch 13. The workbench 20 includes a platform 21 and a positioning seat 22 mounted on the platform 21. The proximity switch 13 of the electric control unit 10 is mounted on the positioning seat 22 of the workbench 20. The cylinder unit 30 is mounted on the workbench 20 and includes a main cylinder 31, a piston 32, a pressure valve 33, an inlet 34, a first air vent 35, a second air vent 36, and a scale adjustment module 37. The piston 32 has a thrust rod 322, a first air chamber 321, and a second air chamber 323. The inlet 34 of the cylinder unit 30 is located at one side of the main cylinder 31. The pressure valve 33 is connected with an external pneumatic source, and is connected to the main cylinder 31, the first air vent 35, and the second air vent 36. The scale adjustment module 37 is connected with the piston 32, and includes an adjusting lever 371, a scale board 372, a follower 374, a buffer cushion 375, and a nut 376. The scale adjustment module 37 is used to regulate the dimension of the first air chamber 321 of the piston 32. The supply unit 40 includes a material inlet 41, a material drawing valve 42, a check valve 43, and a material outlet 44. The material inlet 41 is connected to an external material source. The material drawing valve 42 is connected between the material inlet 41 and the inlet 34 of the cylinder unit 30. The check valve 43 is connected between the material drawing valve 42, the inlet 34 of the cylinder unit 30, and the material outlet 44. The material outlet 44 is located above the positioning seat 22 of the workbench 20.

In practice, the air is pushed through the second air vent 36 into the second air chamber 323 of the piston 32. The material is drawn into the material drawing valve 42 and a pipeline 45. The thrust rod 322 extends outward from the piston 32. The follower 374 is moved with the adjusting lever 371 simultaneously. The nut 376 rests on the buffer cushion 375, to restrict displacement of the adjusting lever 371 and the follower 374. The air is then pushed through the first air vent 35 into the first air chamber 321 of the piston 32 to push and move the piston 32, such that the material in the pipeline 45 is delivered through the check valve 43 and the material outlet 44 into a container 50, to finish the material filling process. However, the material is accumulated on the material inlet 41, the material drawing valve 42, the pipeline 45, and the check valve 43. In addition, the material is easily drawn into the piston 32 when the cylinder unit 30 is operated. The main cylinder 31, the piston 32, and the supply unit 40 are fixed and cannot be dismantled for cleaning or replacement. Thus, when the filling machine is used to fill different materials, the main cylinder 31, the piston 32, and the supply unit 40 easily render mixture of the different materials.

BRIEF SUMMARY OF THE INVENTION

In accordance with the present invention, there is provided a filling machine comprising a main body, a feeding unit, a movement unit, a power unit, a pipe unit, and two control units. The main body is provided with a first seat and a first mounting portion. The feeding unit is mounted on the main body and includes a second seat, a filling cylinder, a first plate, and a connecting member. The movement unit is movable forward and backward relative to the main body and the feeding unit. The movement unit includes a third seat, a first moving member, and a second plate. The power unit is arranged on the movement unit and includes a driving mechanism, and a second moving member. The pipe unit is assembled with the feeding unit, and includes a first line and a second line. The two control units are mounted on the main body to control the first line and the second line. When the first line is closed by one of the two control units, the second line is opened by the other one of the two control units, and when the second line is closed by one of the two control units, the first line is opened by the other one of the two control units.

According to the primary advantage of the present invention, the second moving member of the power unit is moved in the driving mechanism, and drives the movement unit to move in the receiving space of the filling cylinder, such that the staple to be filled is forced to flow through the first line into the second line into the second container by control of the two control units to finish one filling procedure. The filling cylinder, the first moving member, and the pipe unit can be removed, such that the filling cylinder, the first moving member, and the pipe unit are replaced or cleaned directly, to prevent different staples from being mixed during the filling process.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
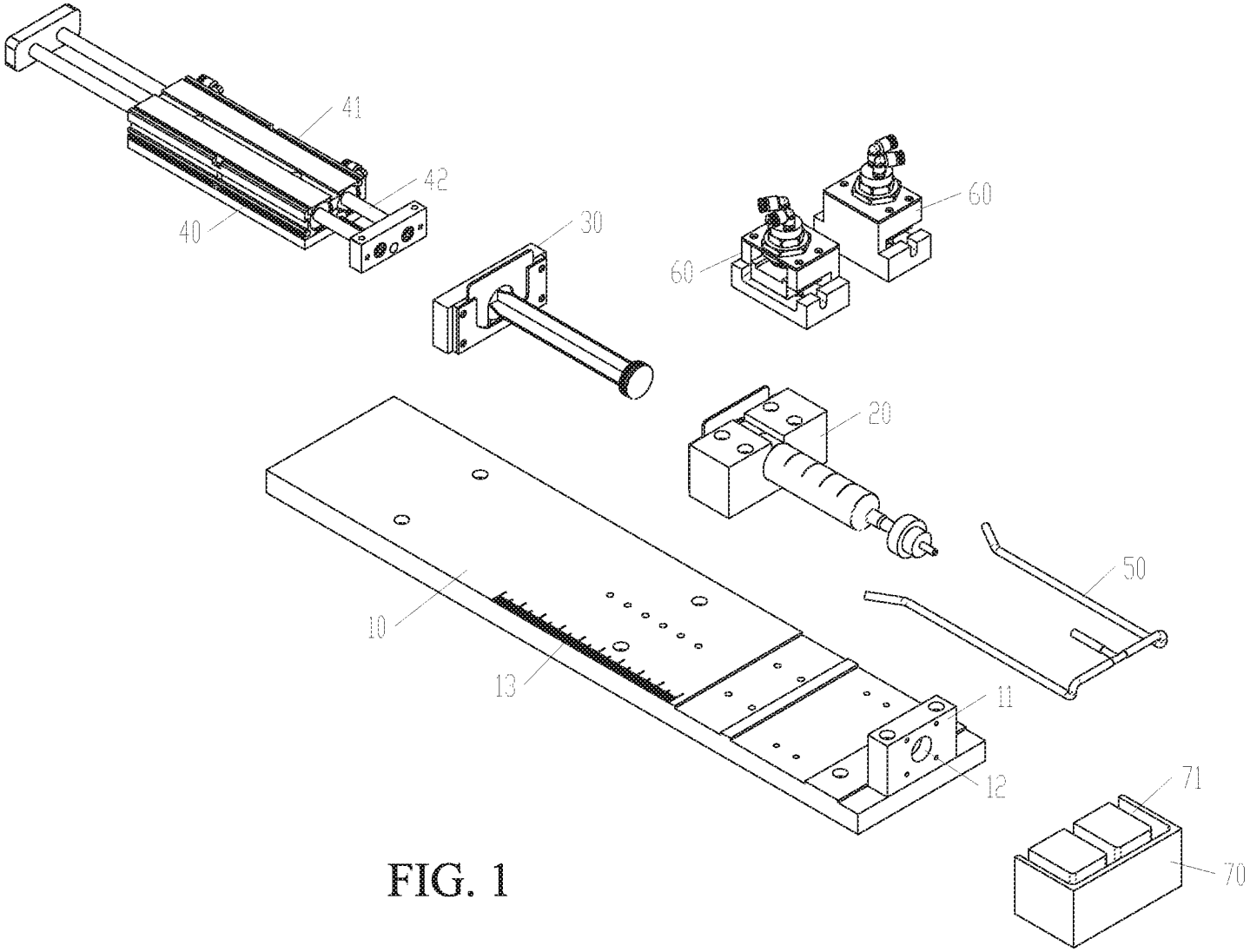
FIG. 1 is an exploded perspective view of a filling machine in accordance with the preferred embodiment of the present invention.
Figure 2:
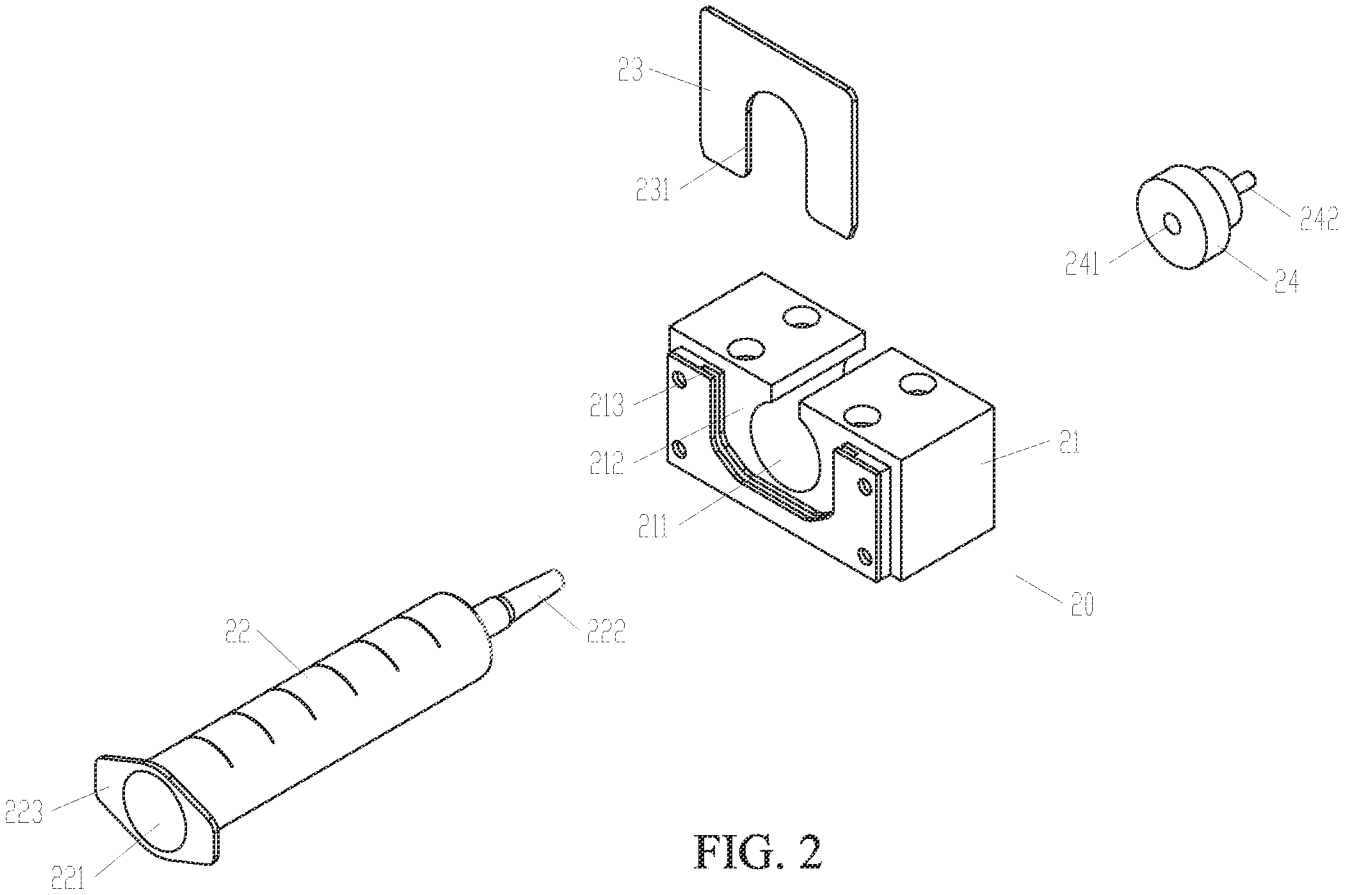
FIG. 2 is an exploded perspective view of a feeding unit of the filling machine in accordance with the preferred embodiment of the present invention.
Figure 3:
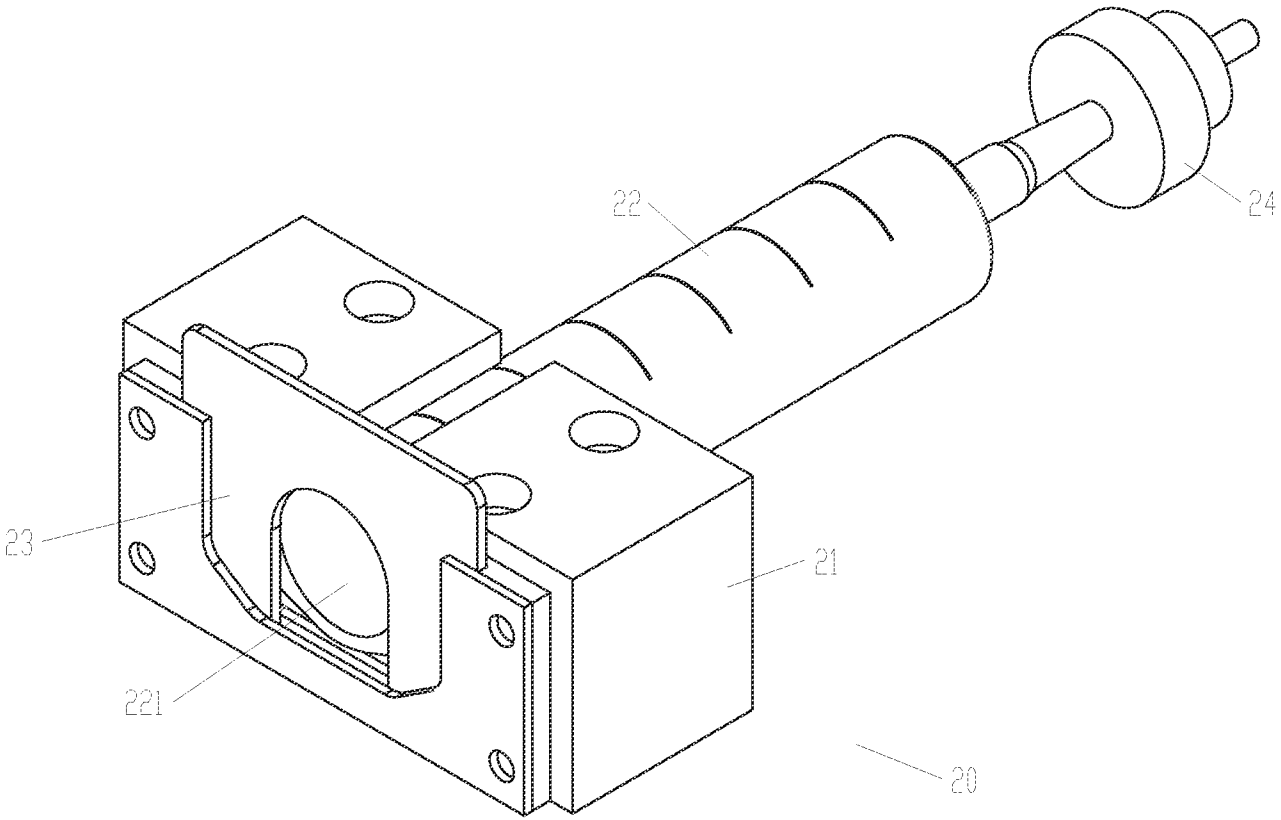
FIG. 3 is a perspective assembly view of the feeding unit of the filling machine as shown in FIG. 2.
Figure 4:
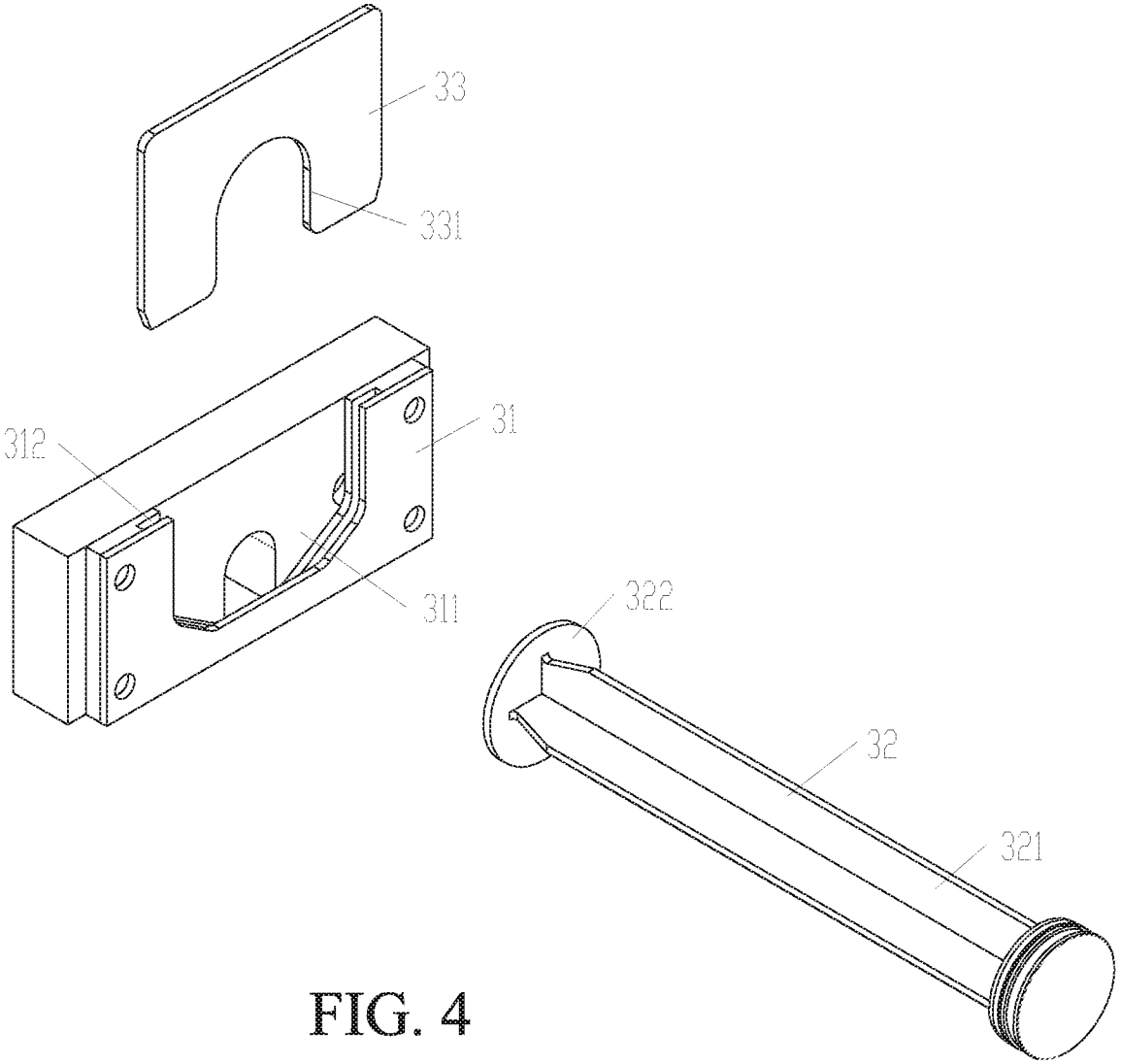
FIG. 4 is an exploded perspective view of a movement unit of the filling machine in accordance with the preferred embodiment of the present invention.
Figure 5:
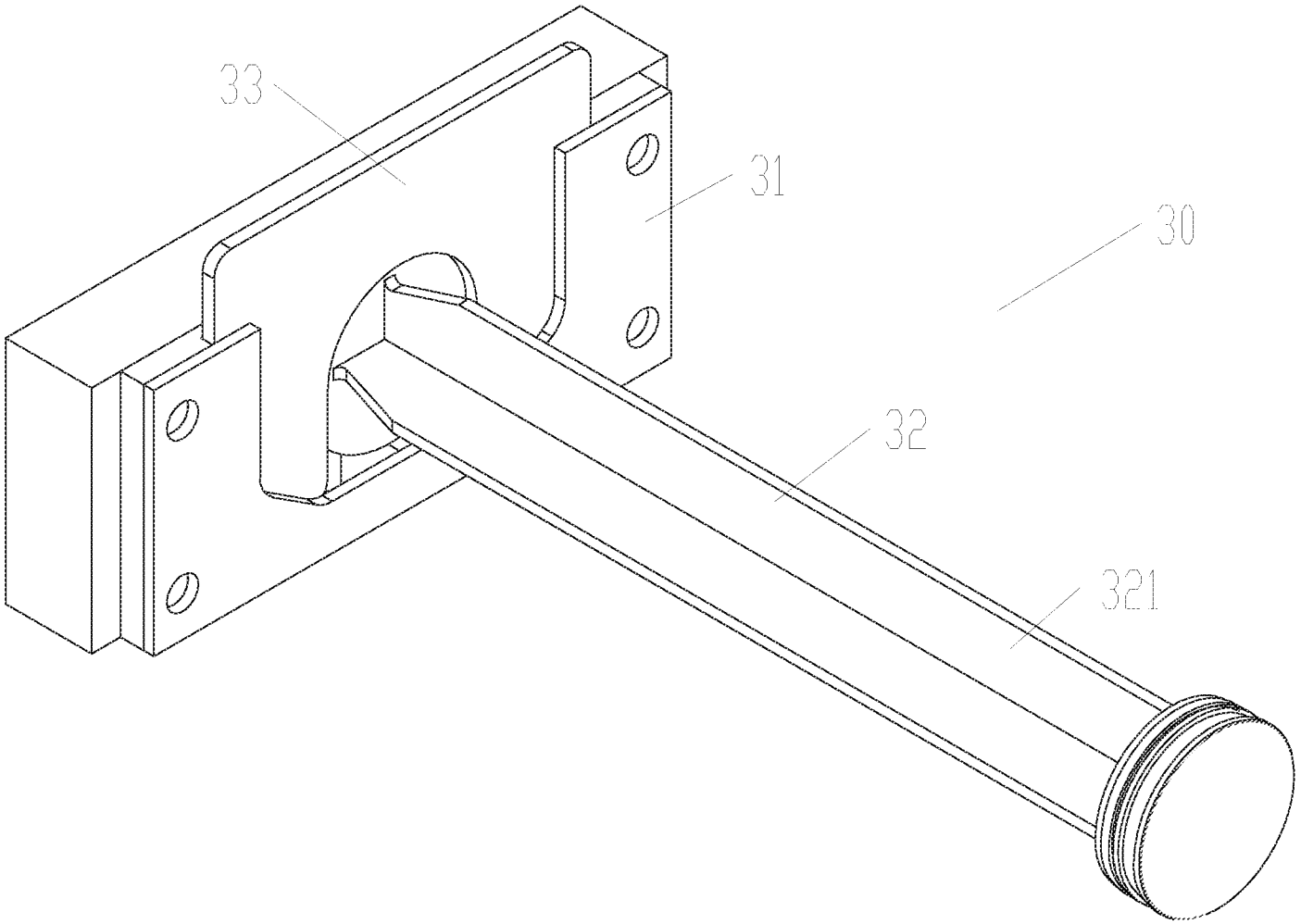
FIG. 5 is a perspective assembly view of the movement unit of the filling machine as shown in FIG. 4.
Figure 6:
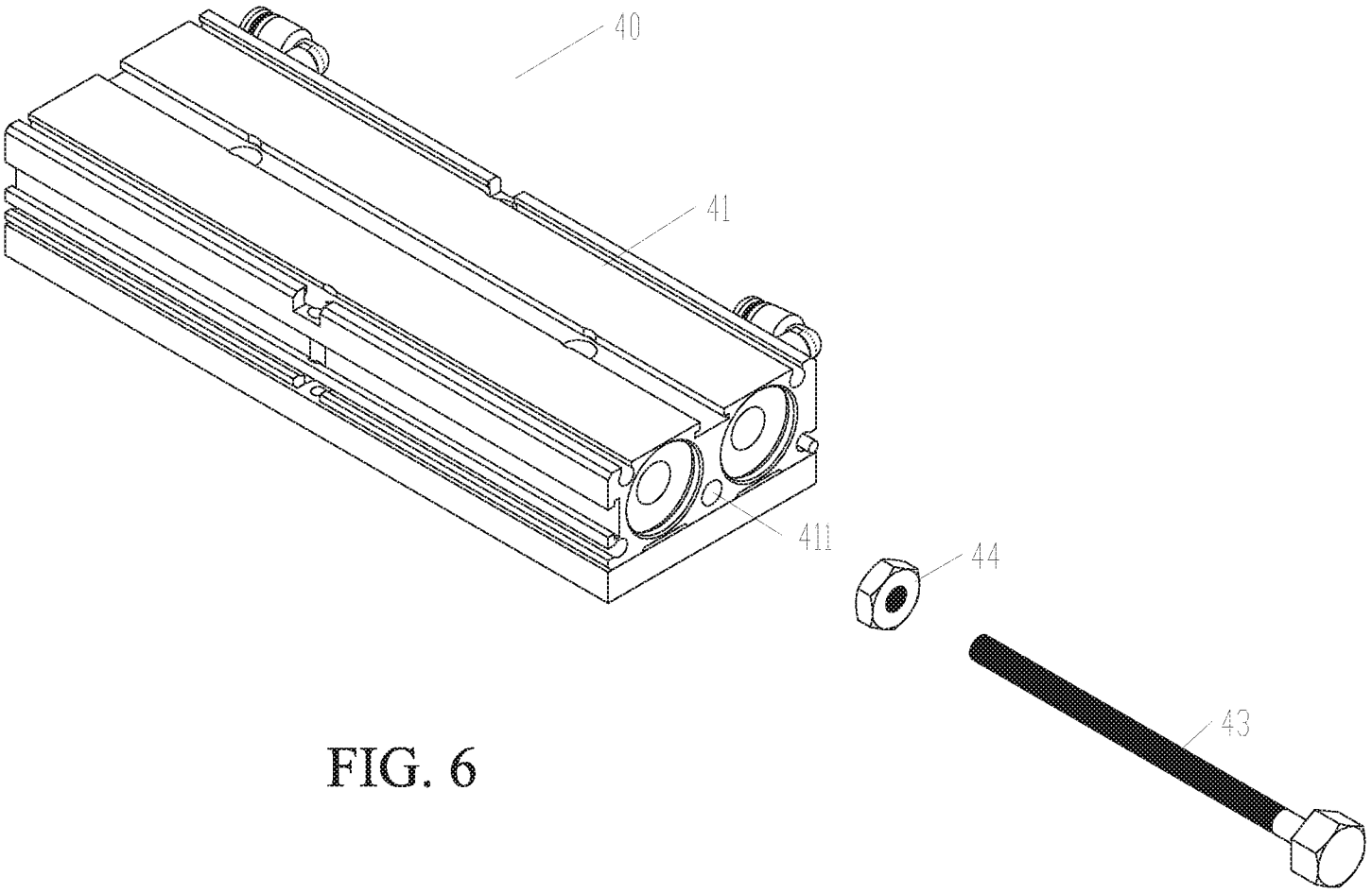
FIG. 6 is a partial exploded perspective view of a power unit of the filling machine in accordance with the preferred embodiment of the present invention.
Figure 7:
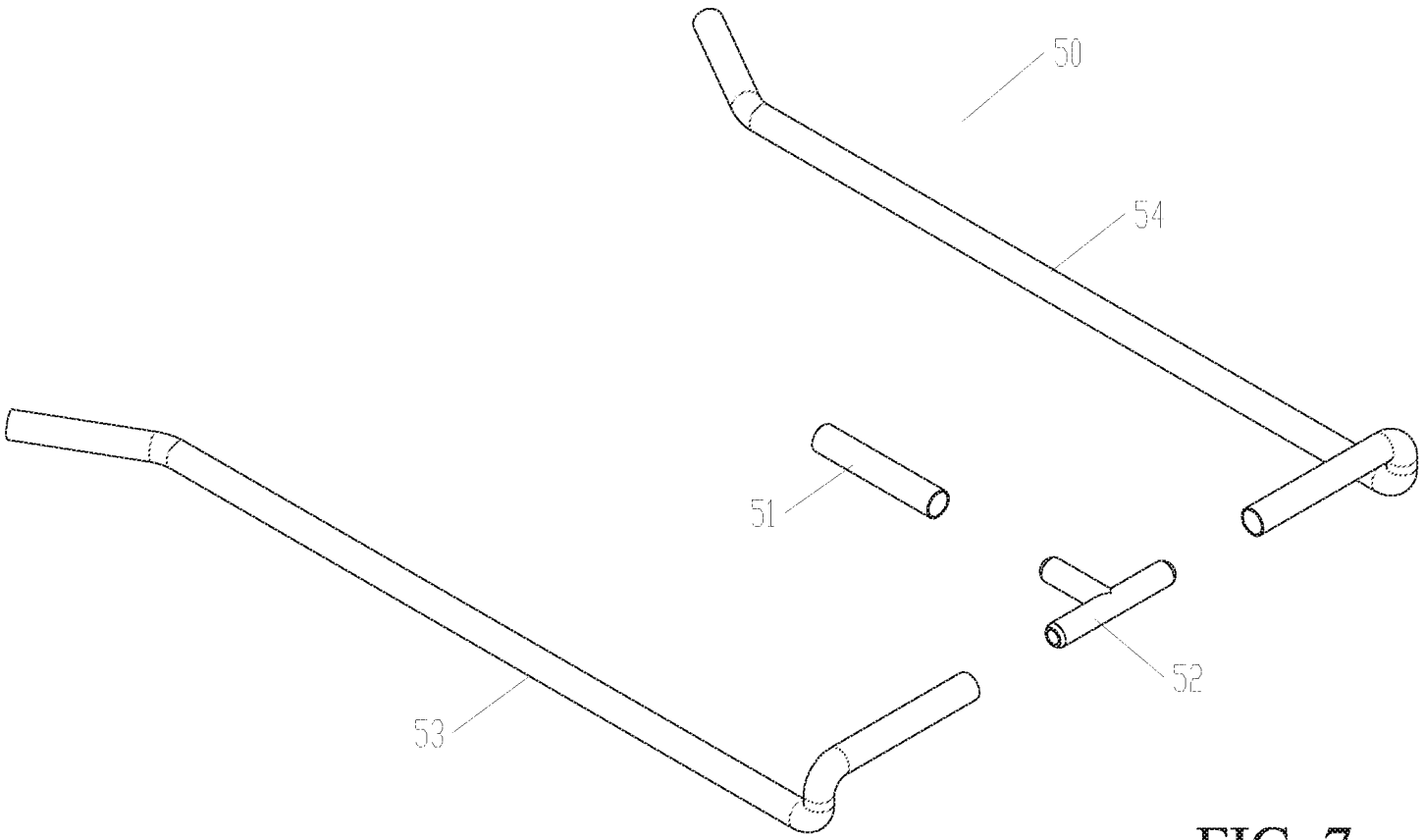
FIG. 7 is an exploded perspective view of a pipe unit of the filling machine in accordance with the preferred embodiment of the present invention.
Figure 8:
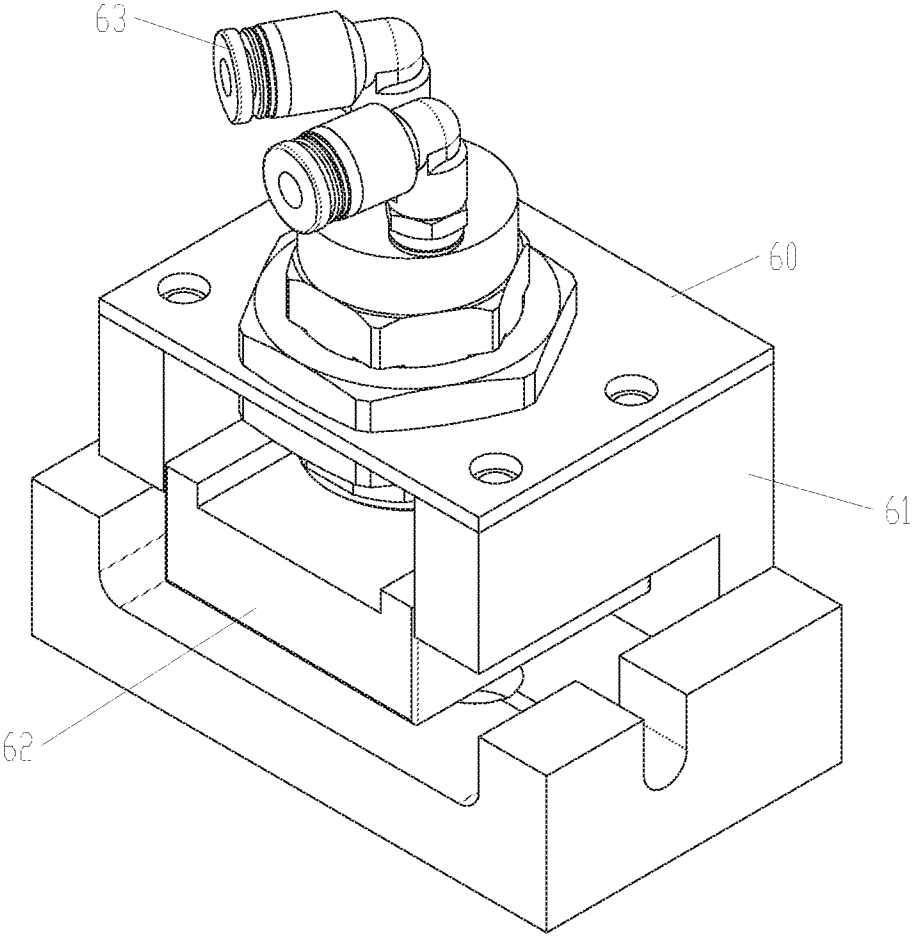
FIG. 8 is a perspective view of a control unit of the filling machine in accordance with the preferred embodiment of the present invention.
Figure 9:
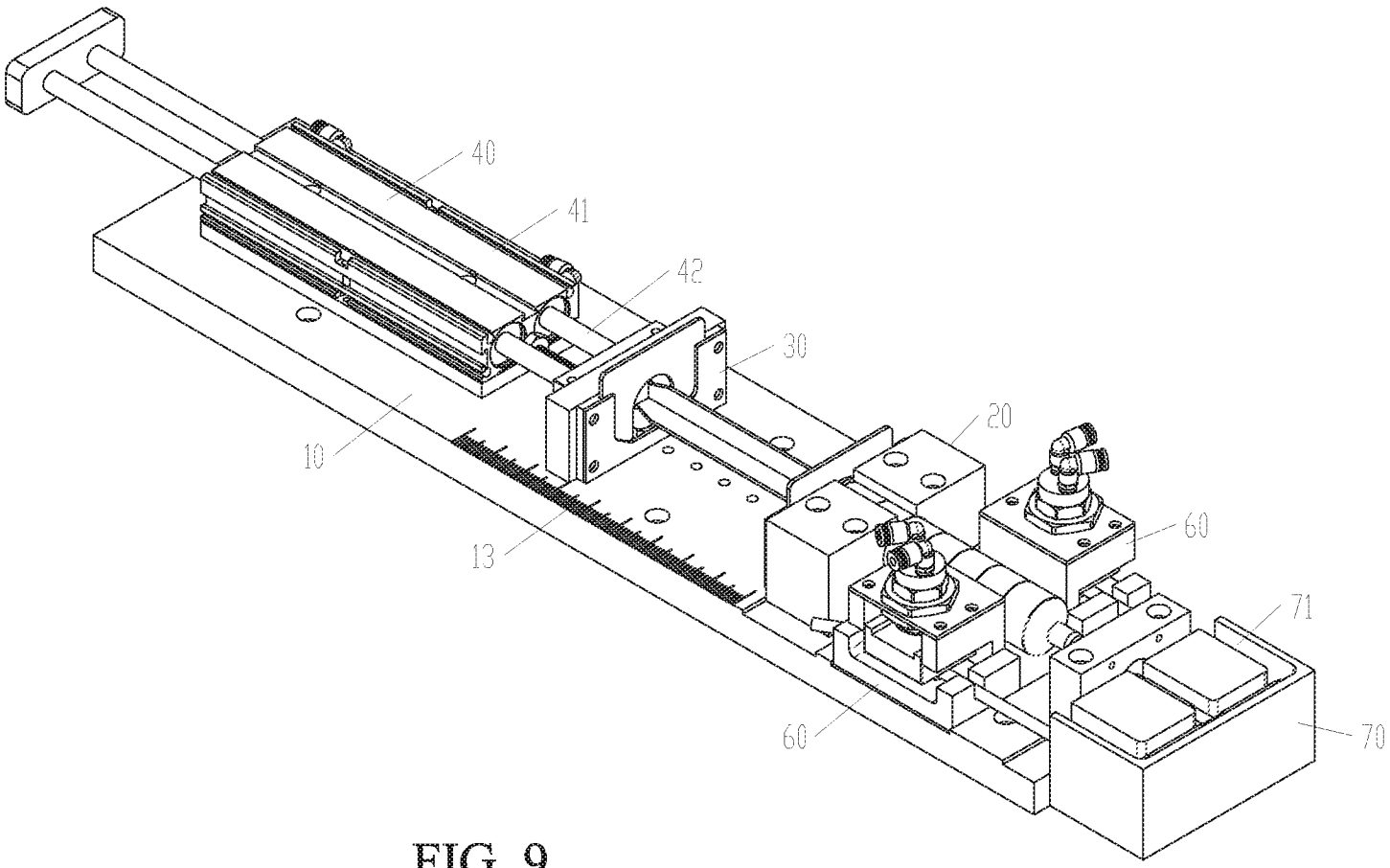
FIG. 9 is a perspective assembly view of the filling machine in accordance with the preferred embodiment of the present invention.

Referring to the drawings and initially to FIGS. 1-10, a filling machine in accordance with the preferred embodiment of the present invention comprises a main body 10, a feeding unit 20, a movement unit 30, a power (or drive) unit 40, a pipe unit 50, and two control units 60.

The main body 10 is provided with a first seat 11. The first seat 11 is provided with a first mounting portion 12.

The feeding unit 20 is mounted on the main body 10 and includes a second seat 21, a filling cylinder (or tube) 22, a first plate 23, and a connecting member 24.

The second seat 21 is secured to the main body 10, and is provided with a second mounting portion 211 which is a channel aligning with the first mounting portion 12. The second seat 21 has an end portion provided with a first abutting face 212 and a first receiving recess 213. The first abutting face 212 is located between the second mounting portion 211 and the first receiving recess 213.

The filling cylinder 22 extends through the second mounting portion 211 and has an interior provided with a receiving space 221. The filling cylinder 22 has a first end provided with a first outlet 222, and a second end provided with a first resting portion 223. The first outlet 222 aligns with the first mounting portion 12 and is connected to the receiving space 221. The first resting portion 223 rests on the first abutting face 212. Thus, the filling cylinder 22 is restricted by the first resting portion 223 and the first abutting face 212, and cannot be detached from the second mounting portion 211.

The first plate 23 is received in the first receiving recess 213, and is directed toward a direction different from that of the filling cylinder 22. The first plate 23 rests on the first resting portion 223 of the filling cylinder 22, such that the first resting portion 223 of the filling cylinder 22 is limited by the first abutting face 212 and the first plate 23, and cannot be detached from the second mounting portion 211. The first plate 23 is an inverted U-shaped sheet plate and is provided with a third mounting portion 231 aligning with the receiving space 221. When the first plate 23 is removed from the first receiving recess 213, the filling cylinder 22 is released from the first plate 23, such that the filling cylinder 22 can be removed from the second seat 21.

The connecting member 24 is mounted on the filling cylinder 22, and is received in the first mounting portion 12 of the first seat 11. The connecting member 24 has an interior provided with a passage 241 mounted on the first outlet 222 of the filling cylinder 22. The connecting member 24 is provided with a second outlet 242. The second outlet 242 is connected to the first outlet 222, and protrudes outward from the first mounting portion 12.

The movement unit 30 is assembled with and movable forward and backward relative to the main body 10 and the feeding unit 20. The movement unit 30 includes a third seat 31, a first moving member 32, and a second plate 33.

The third seat 31 is mounted on the main body 10, and has an end portion provided with a second abutting face 311 and a second receiving recess 312. The second abutting face 311 aligns with the first abutting face 212 of the second seat 21, and is located between the third seat 31 and the second receiving recess 312. The second receiving recess 312 aligns with the first receiving recess 213.

The first moving member 32 is provided with a moving portion 321 and a second resting portion 322. The moving portion 321 is movably mounted in the receiving space 221 of the filling cylinder 22. The second resting portion 322 rests on the second abutting face 311. The first moving member 32 is moved in concert with the third seat 31.

The second plate 33 is received in the second receiving recess 312 of the third seat 31, and is directed toward a direction different from that of the first moving member 32. The second plate 33 rests on the second resting portion 322 of the first moving member 32, such that the second resting portion 322 of the first moving member 32 is limited by the second abutting face 311 and the second plate 33, and cannot be detached from the third seat 31. The second plate 33 is an inverted U-shaped sheet plate and is provided with a fourth mounting portion 331. When the second plate 33 is removed from the second receiving recess 312 of the third seat 31, the first moving member 32 is released from the second plate 33, such that the first moving member 32 can be removed from the third seat 31.

The power unit 40 is assembled with the main body 10 and the movement unit 30. The power unit 40 is arranged on one end of the movement unit 30, with the movement unit 30 being arranged between the feeding unit 20 and the power unit 40. The power unit 40 includes a driving mechanism 41, a second moving member 42, a first screw member 43, and a second screw member 44.

The driving mechanism 41 is mounted on the main body 10, and is provided with a threaded portion 411 which is an internal thread.

The second moving member 42 is secured with the third seat 31 of the movement unit 30. The second moving member 42 is driven by the driving mechanism 41, and drives and moves the movement unit 30 on the main body 10, such that the first moving member 32 is moved in the receiving space 221.

The first screw member 43 is screwed into and movable in the threaded portion 411 of the driving mechanism 41, to adjust a movement distance of the second moving member 42.

The second screw member 44 is screwed onto the first screw member 43, and rests on an opening of the threaded portion 411, such that the first screw member 43 is positioned on the threaded portion 411 of the driving mechanism 41. When the user wishes to adjust a movement distance between the second moving member 42 and the driving mechanism 41, the second screw member 44 is rotated and unscrewed, such that the first screw member 43 is moved relative to the threaded portion 411, to adjust the movement distance between the second moving member 42 and the driving mechanism 41. The movement distance of the second moving member 42 relative to the driving mechanism 41 is equal to that of the movement unit 30 relative to the main body 10.

The pipe unit 50 is assembled with the feeding unit 20, and includes a first connecting pipe 51, a second connecting pipe 52, a first line 53, and a second line 54.

The first connecting pipe 51 is mounted on the second outlet 242 of the connecting member 24.

The second connecting pipe 52 is connected with the first connecting pipe 51, with the first connecting pipe 51 being arranged between the connecting member 24 and the second connecting pipe 52. The second connecting pipe 52 has a T-shaped configuration.

The first line 53 and the second line 54 are connected with the second connecting pipe 52, with the second connecting pipe 52 being located between the first line 53 and the second line 54. The first line 53 and the second line 54 are arranged at two sides of the first seat 11 and align with each other. Each of the first line 53 and the second line 54 is a hose.

The two control units 60 are mounted on the main body 10 and assembled with the pipe unit 50, with the feeding unit 20 being arranged between the two control units 60. Each of the two control units 60 includes a fourth seat 61, a control member 62, and an input module 63. The first line 53 and the second line 54 extend through and partially protrude outward from the fourth seats 61 of the two control units 60. The control member 62 is movably mounted in the fourth seat 61 and is movable to press and close the first line 53 and the second line 54 or to release and open the first line 53 and the second line 54. The input module 63 drives and moves the control member 62. When the first line 53 is pressed and closed by the control member 62 of one of the two control units 60, the second line 54 is released and opened by the control member 62 of the other one of the two control units 60, and when the second line 54 is pressed and closed by the control member 62 of one of the two control units 60, the first line 53 is released and opened by the control member 62 of the other one of the two control units 60.

Figure 10:
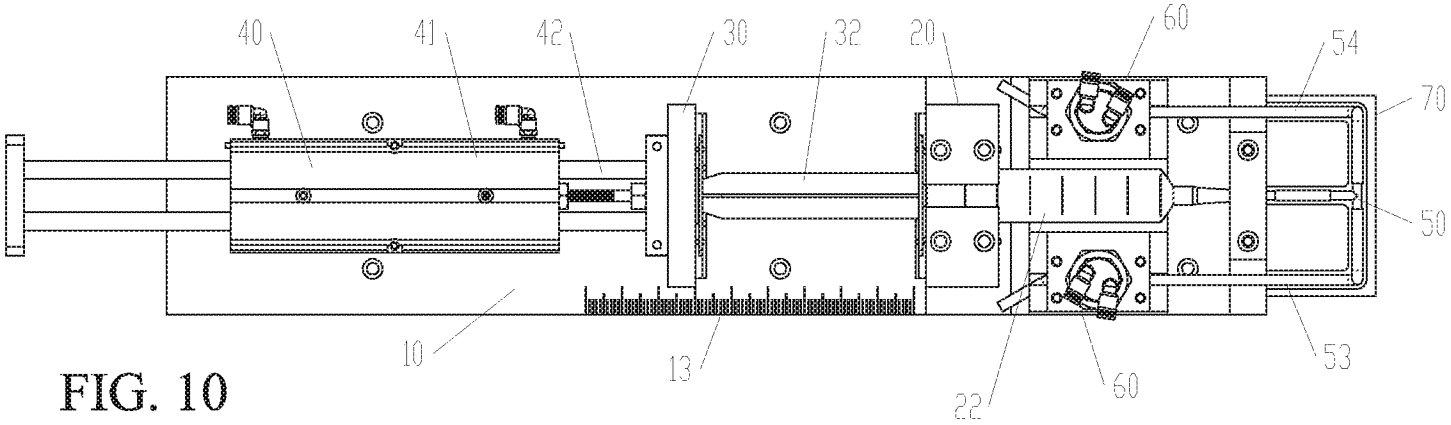
FIG. 10 is a top view of the filling machine as shown in FIG. 9.

In practice, when the second line 54 is closed, the first line 53 is opened, and the driving mechanism 41 drives the second moving member 42 which drives the movement unit 30 which drives the first moving member 32 which is moved in the receiving space 221 of the filling cylinder 22 and moved toward the driving mechanism 41 as shown in FIG. 10, such that a staple (or material) is driven to flow through the first line 53, the second connecting pipe 52, the first connecting pipe 51, the second outlet 242, the passage 241, and the first outlet 222 into the receiving space 221.

Figure 11:
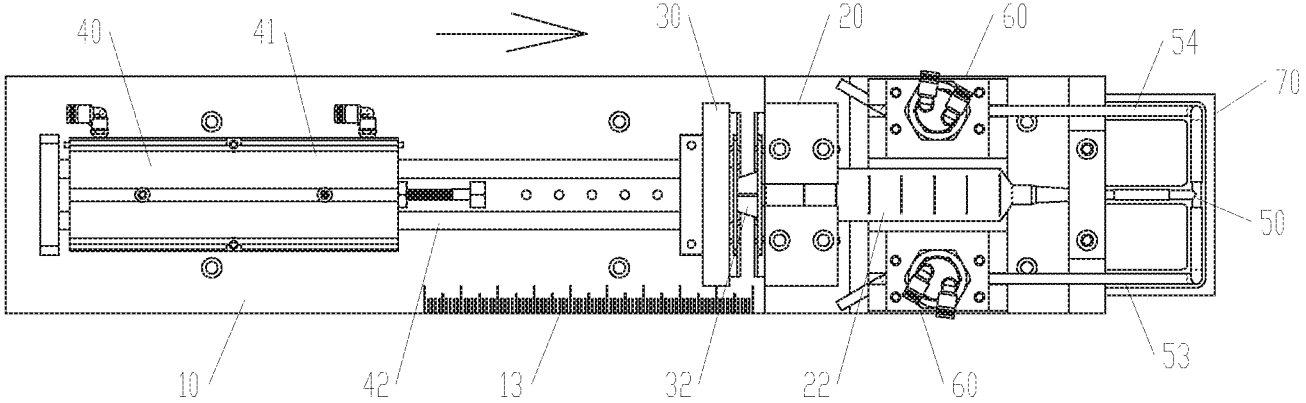
FIG. 11 is a schematic operational view of the filling machine as shown in FIG. 10.

Alternatively, when the first line 53 is closed, the second line 54 is opened, and the driving mechanism 41 drives the second moving member 42 which drives the movement unit 30 which drives the first moving member 32 which is moved in the receiving space 221 of the filling cylinder 22 and moved toward the pipe unit 50 as shown in FIG. 11, such that the staple in the receiving space 221 is driven to flow through the first outlet 222, the passage 241, the second outlet 242, the first connecting pipe 51, the second connecting pipe 52, and the second line 54, and flow outward from the second line 54. Thus, a filling work is finished.

The filling machine further comprises a fifth seat 70 secured to an end of the main body 10 and provided with a receiving slot 71. The receiving slot 71 receives the second outlet 242 of the feeding unit 20 and the pipe unit 50. The second outlet 242 of the connecting member 24 and the first connecting pipe 51 are connected in the receiving slot 71. The first connecting pipe 51 and the second connecting pipe 52 of the pipe unit 50 are received in the receiving slot 71. The first line 53 and the second line 54 of the pipe unit 50 extends through the receiving slot 71.

In the preferred embodiment of the present invention, the main body 10 is a rectangular board with a determined length. The first seat 11 has a rectangular shape and is perpendicular to the main body 10. The first mounting portion 12 has a circular shape. The main body 10 is provided with an indication portion 13 which includes a scale.

In the preferred embodiment of the present invention, the second seat 21 is parallel with the first seat 11, and is perpendicular to the main body 10. The second seat 21 has a rectangular shape.

In the preferred embodiment of the present invention, the filling cylinder 22 is a syringe, and the receiving space 221 has a circular shape.

In the preferred embodiment of the present invention, the connecting member 24 has a cylindrical shape.

In the preferred embodiment of the present invention, the third seat 31 is parallel with the second seat 21, and is perpendicular to the main body 10. The third seat 31 aligns with the second seat 21 and the indication portion 13.

In the preferred embodiment of the present invention, the second moving member 42 extends into the driving mechanism 41. The driving mechanism 41 and the second moving member 42 construct a pneumatic cylinder structure.

In the preferred embodiment of the present invention, the input module 63 is connected with a pneumatic driving unit.

In operation, referring to FIG. 11 with reference to FIGS. 1-10, the second moving member 42 of the power unit 40 is moved in the driving mechanism 41, and drives the movement unit 30 to move on the main body 10 and move in the receiving space 221 of the filling cylinder 22. The first line 53 is connected with a first container, and the second line 54 is connected with a second container, such that the staple in the first container is allowed to flow through the first line 53 and the second line 54 into the second container by control of the two control units 60.

Figure 12:
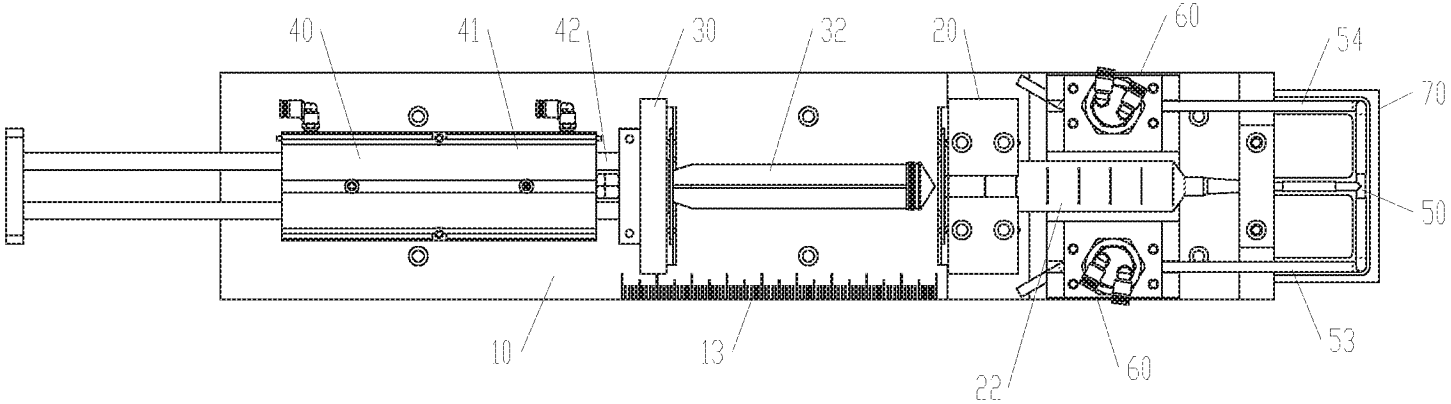
FIG. 12 is another schematic operational view of the filling machine as shown in FIG. 10.
Figure 13:
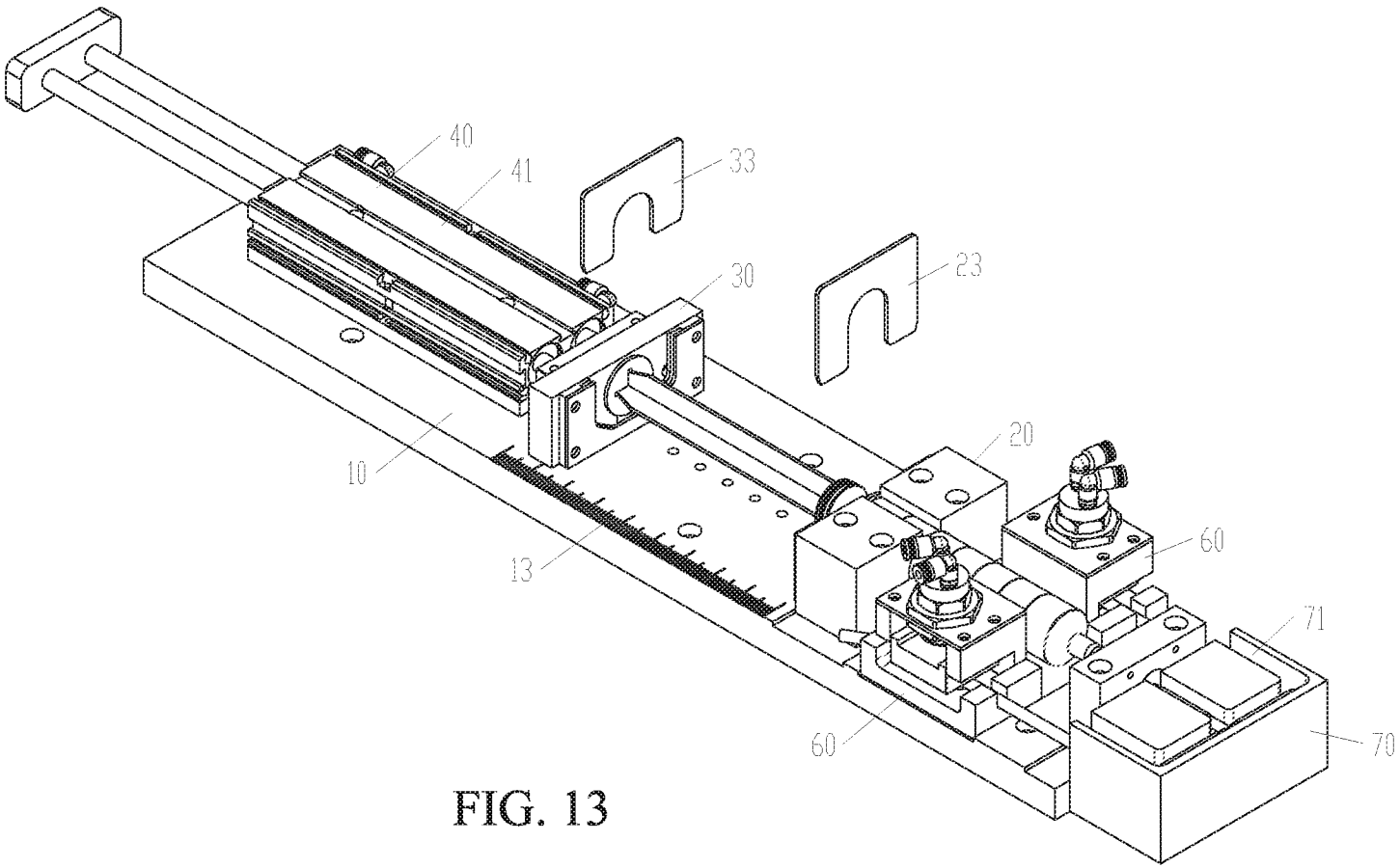
FIG. 13 is a partial exploded perspective view of the filling machine as shown in FIG. 9.
Figure 14:
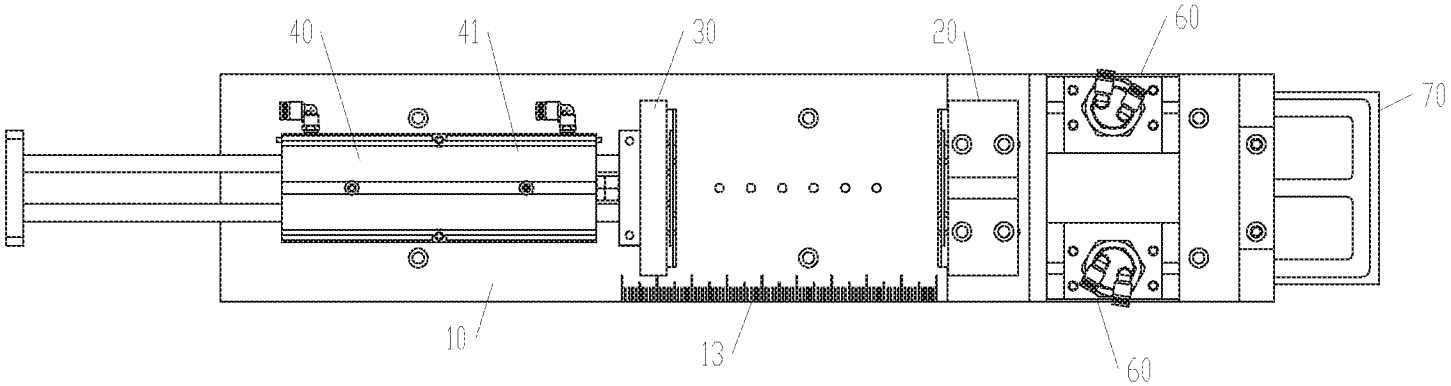
FIG. 14 is a top view showing the first moving member being removed.

Referring to FIGS. 12-14 with reference to FIGS. 1-10, when the second screw member 44 is rotated and unscrewed, the first screw member 43 is rotated and moved relative to the threaded portion 411, such that the distance between the second moving member 42 and the driving mechanism 41 is reduced to the minimum. When the second moving member 42 of the power unit 40 is moved backward, the movement unit 30 is moved backward, such that the moving portion 321 of the first moving member 32 is moved and detached from the receiving space 221 of the filling cylinder 22 as shown in FIG. 12. When the first plate 23 is removed from the first receiving recess 213 of the feeding unit 20 as shown in FIG. 13, the filling cylinder 22 is released from the first plate 23, and is detached from the second mounting portion 211 of the second seat 21. When the second plate 33 is removed from the second receiving recess 312 of the movement unit 30 as shown in FIG. 13, the first moving member 32 is released from the second plate 33, and is detached from the third seat 31. The connecting member 24 is removed from the first outlet 222 of the filling cylinder 22, and the second outlet 242 of the connecting member 24 is removed from the first connecting pipe 51, such that the pipe unit 50 is detached from the two control units 60 and the fifth seat 70. Thus, the filling cylinder 22, the first moving member 32, and the pipe unit 50 are removed for replacement.

Figure 15:
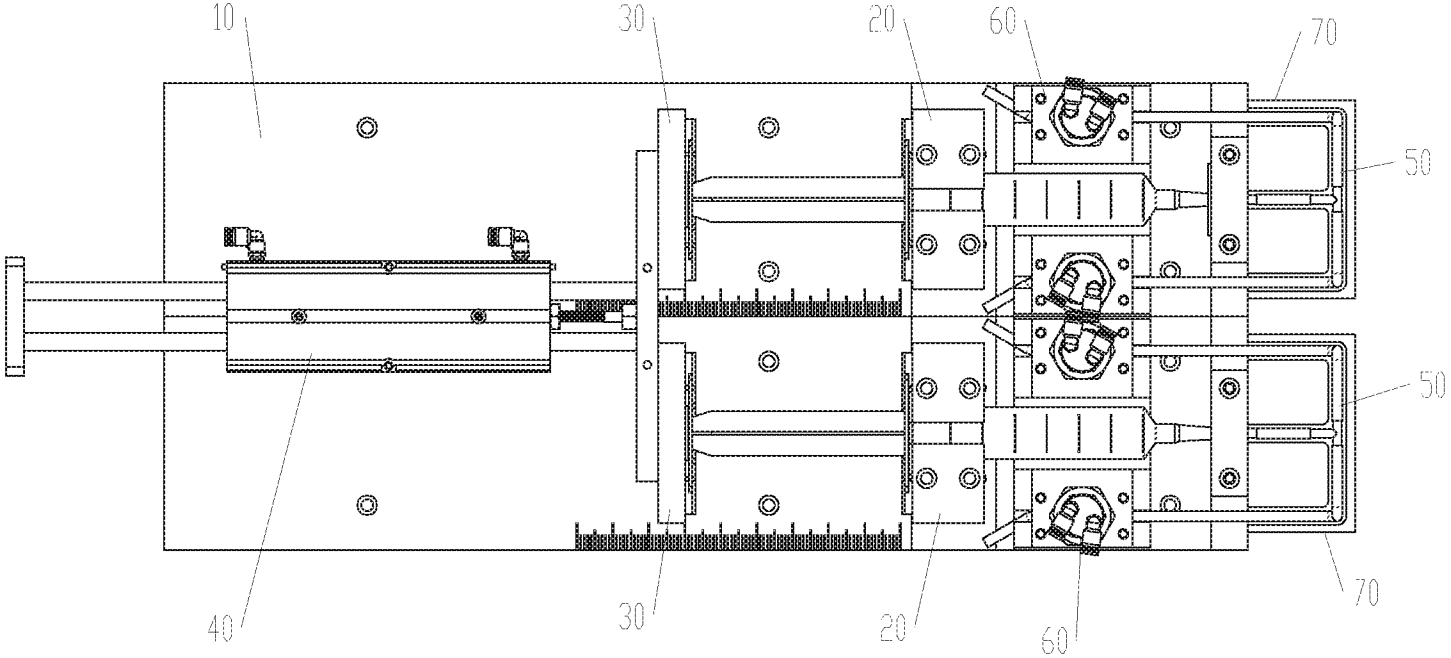
FIG. 15 is a top view of a filling machine in accordance with another preferred embodiment of the present invention.

Referring to FIG. 15, the filling machine comprises two feeding units 20, two movement units 30, two pipe units 50, four control units 60, and two fifth seats 70. The power unit 40 is assembled with and drives the two movement units 30 simultaneously. Each of the two movement units 30 cooperates with one of the two feeding units 20, one of the two pipe units 50, two of the four control units 60, and one of the two fifth seats 70.

In another preferred embodiment of the present invention, the filling cylinder 22 and the connecting member 24 are formed integrally, and the first outlet 222 of the filling cylinder 22 is mounted on the first mounting portion 12.

In another preferred embodiment of the present invention, the first plate 23 is elastic to provide an elastic resistance when the first plate 23 is mounted in or removed from the first receiving recess 213, and the second plate 33 is elastic to provide an elastic resistance when the second plate 33 is mounted in or removed from the second receiving recess 312.

In another preferred embodiment of the present invention, each of the two control units 60 is an electromagnetic valve which is connected with the first line 53 and the second line 54. When the pipe unit 50 is detached, the two control units 60 are also removed.

Accordingly, the filling machine has the following advantages.

1. The second moving member 42 of the power unit 40 is moved in the driving mechanism 41, and drives the movement unit 30 to move in the receiving space 221 of the filling cylinder 22, such that the staple to be filled is forced to flow through the first line 53 into the second line 54 into the second container by control of the two control units 60 to finish one filling procedure.

2. The filling cylinder 22, the first moving member 32, and the pipe unit 50 can be removed, such that the filling cylinder 22, the first moving member 32, and the pipe unit 50 are replaced or cleaned directly, to prevent different staples from being mixed during the filling process.

3. The first line 53 of the pipe unit 50 is placed in a large barrel, and the second line 54 is placed in a small container, such that the staple in the large barrel is filled into the small container through the first line 53 and the second line 54. The staple will touch the pipe unit 50, the filling cylinder 22, and the first moving member 32 during the filling process. Thus, the filling cylinder 22, the first moving member 32, and the pipe unit 50 may be replaced, to prevent different staples from being mixed during the filling process.

4. The first plate 23 is directed toward a direction different from that of the filling cylinder 22, and the second plate 33 is directed toward a direction different from that of the first moving member 32. The vibration produced by the power unit 40 is directed toward a direction the same as that of the filling cylinder 22 and that of the first moving member 32, such that the first plate 23 and the second plate 33 are not displaced easily by the vibration, thereby assuring the structural safety.

5. The first plate 23, the second plate 33, the filling cylinder 22, the first moving member 32, and the pipe unit 50 are removed without needing any hand tool, thereby facilitating the user assembling and disassembling the first plate 23, the second plate 33, the filling cylinder 22, the first moving member 32, and the pipe unit 50.

6. The first plate 23 is received in the first receiving recess 213 of the second seat 21, and rests on the first resting portion 223 of the filling cylinder 22, such that the filling cylinder 22 and the first plate 23 are mounted on the second seat 21 quickly.

7. The second plate 33 is received in the second receiving recess 312 of the third seat 31, and rests on the second resting portion 322 of the first moving member 32, such that the first moving member 32 and the second plate 33 are mounted on the third seat 31 quickly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A filling machine comprising:

a main body, a feeding unit, a movement unit, a power unit, a pipe unit, and two control units;

wherein:

the main body is provided with a first seat;

the first seat is provided with a first mounting portion formed in the first seat;

the feeding unit is mounted on the main body and includes a second seat, a filling cylinder, a first plate, and a connecting member;

the second seat is secured to the main body, and is provided with a second mounting portion;

the second seat has an end portion provided with a first abutting face and a first receiving recess;

the first abutting face is located between the second mounting portion and the first receiving recess;

the filling cylinder extends through the second mounting portion and has an interior provided with a receiving space;

the filling cylinder has a first end provided with a first outlet, and a second end provided with a first resting portion;

the first outlet is connected to the receiving space;

the first resting portion rests on the first abutting face;

the filling cylinder is restricted by the first resting portion and the first abutting face;

the first plate is inserted into and received in the first receiving recess, and is directed toward a direction different from that of the filling cylinder;

the first plate rests on the first resting portion of the filling cylinder, such that the first resting portion of the filling cylinder is limited by the first abutting face and the first plate;

when the first plate is removed from the first receiving recess, the filling cylinder is released from the first plate, such that the filling cylinder can be removed from the second seat;

the connecting member is mounted on the filling cylinder, and is inserted through the first mounting portion of the first seat;

the connecting member has an interior provided with a passage mounted on the first outlet of the filling cylinder;

the connecting member is provided with a second outlet;

the second outlet is connected to the first outlet, and protrudes outward from the first mounting portion;

the movement unit is movable forward and backward relative to the main body and the feeding unit;

the movement unit includes a third seat, a first moving member, and a second plate;

the third seat is mounted on the main body, and has an end portion provided with a second abutting face and a second receiving recess;

the second abutting face is located between the third seat and the second receiving recess;

the first moving member is provided with a moving portion and a second resting portion;

the moving portion is movably mounted in the receiving space of the filling cylinder;

the second resting portion rests on the second abutting face;

the first moving member is moved in concert with the third seat;

the second plate is inserted into and received in the second receiving recess of the third seat, and is directed toward a direction different from that of the first moving member;

the second plate rests on the second resting portion of the first moving member, such that the second resting portion of the first moving member is limited by the second abutting face and the second plate;

when the second plate is removed from the second receiving recess of the third seat, the first moving member is released from the second plate, such that the first moving member can be removed from the third seat;

the power unit is arranged on the movement unit, with the movement unit being arranged between the feeding unit and the power unit;

the power unit includes a driving mechanism, a second moving member, a first screw member, and a second screw member;

the driving mechanism is mounted on the main body, and is provided with a threaded portion which is an internal thread;

the second moving member is secured with the third seat of the movement unit;

the second moving member is driven by the driving mechanism, and drives the movement unit on the main body, such that the first moving member is moved in the receiving space;

the first screw member is screwed into and movable in the threaded portion of the driving mechanism;

the second screw member is screwed onto the first screw member, and rests on an opening of the threaded portion, such that the first screw member is positioned on the threaded portion of the driving mechanism;

the second screw member is rotated and unscrewed, such that the first screw member is moved relative to the threaded portion;

a movement distance of the second moving member relative to the driving mechanism is equal to that of the movement unit relative to the main body;

the pipe unit is assembled with the feeding unit, and includes a first connecting pipe, a second connecting pipe, a first line, and a second line;

the first connecting pipe is mounted on the second outlet of the connecting member;

the second connecting pipe is connected with the first connecting pipe, with the first connecting pipe being arranged between the connecting member and the second connecting pipe;

the first line and the second line are connected with the second connecting pipe, with the second connecting pipe being located between the first line and the second line;

the two control units are mounted on the main body;

each of the two control units includes a fourth seat, a control member, and an input module;

the first line and the second line extend through the fourth seats of the two control units;

the control member is movably mounted in the fourth seat and is movable to press and close the first line and the second line or to release and open the first line and the second line;

the input module drives the control member;

when the first line is pressed and closed by the control member of one of the two control units, the second line is released and opened by the control member of the other one of the two control units, and when the second line is pressed and closed by the control member of one of the two control units, the first line is released and opened by the control member of the other one of the two control units;

when the second line is closed, the first line is opened, and the driving mechanism drives the second moving member which drives the movement unit which drives the first moving member which is moved in the receiving space of the filling cylinder and moved toward the driving mechanism, such that a staple is driven to flow through the first line, the second connecting pipe, the first connecting pipe, the second outlet, the passage, and the first outlet into the receiving space;

when the first line is closed, the second line is opened, and the driving mechanism drives the second moving member which drives the movement unit which drives the first moving member which is moved in the receiving space of the filling cylinder and moved toward the pipe unit, such that the staple in the receiving space is driven to flow through the first outlet, the passage, the second outlet, the first connecting pipe, the second connecting pipe, and the second line, and flow outward from the second line;

the filling machine further comprises a fifth seat secured to an end of the main body and provided with a receiving slot;

the receiving slot receives the pipe unit;

the second moving member of the power unit is moved in the driving mechanism, and drives the movement unit to move on the main body and move in the receiving space of the filling cylinder;

the first line is connected with a first container;

the second line is connected with a second container;

the staple in the first container is allowed to flow through the first line and the second line into the second container by control of the two control units;

when the second moving member of the power unit is moved backward, the movement unit is moved backward, such that the moving portion of the first moving member is moved and detached from the receiving space of the filling cylinder;

when the first plate is removed from the first receiving recess of the feeding unit, the filling cylinder is released from the first plate, and is detached from the second mounting portion of the second seat;

when the second plate is removed from the second receiving recess of the movement unit, the first moving member is released from the second plate and is detached from the third seat.

2. The filling machine of claim 1, wherein:

the main body is a rectangular board;

the first seat has a rectangular shape and is perpendicular to the main body;

the first mounting portion has a circular shape; and the main body is provided with an indication portion.

3. The filling machine of claim 1, wherein the second seat is parallel with the first seat, and is perpendicular to the main body, and the second seat has a rectangular shape.

4. The filling machine of claim 1, wherein the filling cylinder is a syringe, and the receiving space has a circular shape.

5. The filling machine of claim 1, wherein the connecting member has a cylindrical shape.

6. The filling machine of claim 2, wherein the third seat is parallel with the second seat, and is perpendicular to the main body, and the third seat aligns with the second seat and the indication portion.

7. The filling machine of claim 1, wherein the second moving member extends into the driving mechanism, and the driving mechanism and the second moving member construct a pneumatic cylinder structure.

8. The filling machine of claim 1, wherein:

the filling machine comprises two feeding units, two movement units, two pipe units, four control units, and two fifth seats;

the power unit is assembled with and drives the two movement units simultaneously; and each of the two movement units cooperates with one of the two feeding units, one of the two pipe units, two of the four control units, and one of the two fifth seats.

9. The filling machine of claim 1, wherein the filling cylinder and the connecting member are formed integrally, and the first outlet of the filling cylinder is mounted on the first mounting portion.

10. The filling machine of claim 1, wherein the first plate is elastic to provide an elastic resistance when the first plate is mounted in or removed from the first receiving recess, and the second plate is elastic to provide an elastic resistance when the second plate is mounted in or removed from the second receiving recess.

11. The filling machine of claim 1, wherein each of the two control units is an electromagnetic valve which is connected with the first line and the second line.

* * * * *